US005299704A

United States Patent [19]

Thorby

[11] Patent Number: 5,299,704

[45] Date of Patent: Apr. 5, 1994

[54] COLLAPSIBLE LOCKER BOX

[76] Inventor: Donald F. Thorby, Burrawong Park, Binnaway, New South Wales 2395, Australia

[21] Appl. No.: 916,205

[22] Filed: Jul. 17, 1992

[30] Foreign Application Priority Data

Jul. 18, 1991 [AU] Australia ..... PK7314

[51] Int. Cl.[5] ..... B65D 6/12

[52] U.S. Cl. ..... 220/6

[58] Field of Search ..... 220/6

[56] References Cited

U.S. PATENT DOCUMENTS 2,803,084 8/1957 Frerking ..... 220/6
2,934,389 4/1960 Krey ..... 220/6
3,096,923 7/1963 Piller ..... 220/6
3,527,339 9/1970 Cipolla ..... 220/6
3,527,340 9/1970 Cipolla ..... 220/6
4,714,013 12/1987 Telfer ..... 220/6

*Primary Examiner*—Joseph Man-Fu Moy
*Attorney, Agent, or Firm*—Ladas & Parry

[57] ABSTRACT

The present invention discloses a locker box (1) movable between an open, use, configuration and a collapsed storage configuration. The locker is particularly suited for use on motor vehicles. The locker box (1) comprises a base (2), two side walls (4), two end walls (5) and a lid (6). The end walls (5) are foldable such that the two side walls (4) are able to approach one another when the locker box is not in use.

7 Claims, 2 Drawing Sheets

COLLAPSIBLE LOCKER BOX

The present invention relates to locker boxes, and in particular, to a collapsible locker box which is used in trucks and the like to enable the carry space of the truck to be used when the locker box is not being used.

The use of locker boxes is common on small load trucks which have a tray. The locker box is used to store tools and other equipment and to supply security against theft. The locker box is generally securable to the tray of the truck and as such uses a substantial amount of space on the tray. It is possible for the locker box to be removed from the truck to provide the extra space on the tray provided that the locker box has not been welded to the tray.

The disadvantage of a locker box attached to the tray of a truck is that a substantial amount of the space of the tray is forfeited.

It is an object of the present invention to provide a collapsible locker box which substantially overcomes or ameliorates the abovementioned disadvantages.

According to one aspect of the present invention there is disclosed a locker box movable between an operating configuration and a collapsed storage configuration, said box comprising a base, two side walls and two end walls wherein said end walls are foldable and said two side walls are movable between an operating position in which they are spaced apart by the end walls, and a storage position in which said side walls are closely spaced together.

One embodiment of the present invention will now be described with reference to the drawings in which.

Figure 1:
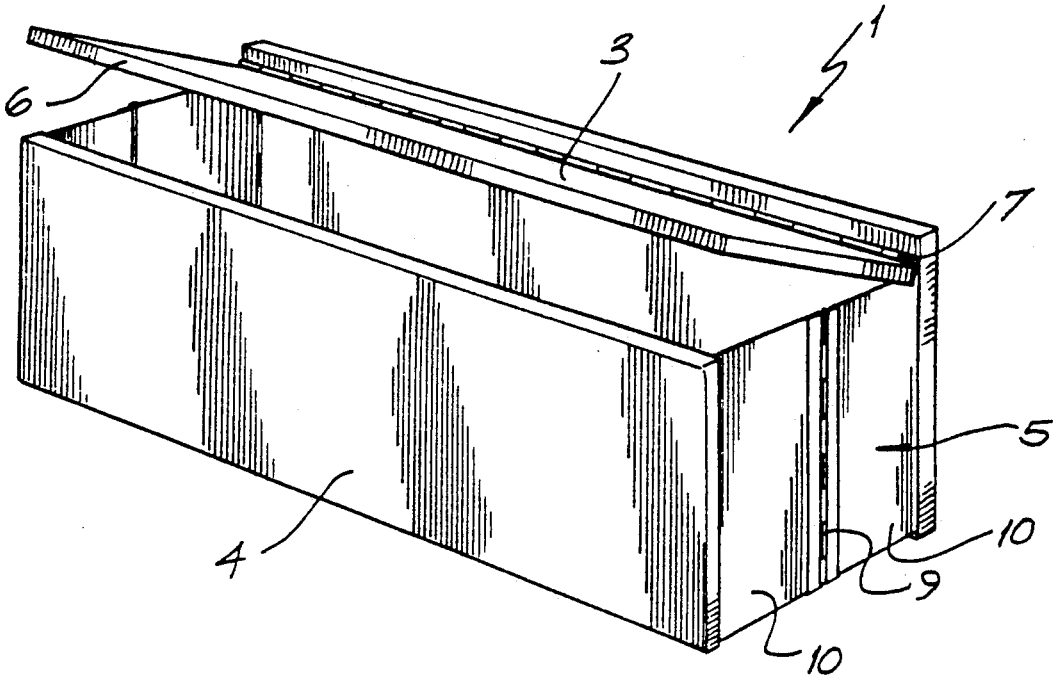
FIG. 1 is a perspective view of the collapsible locker box of the preferred embodiment illustrated in its open or operating configuration.
Figure 2:
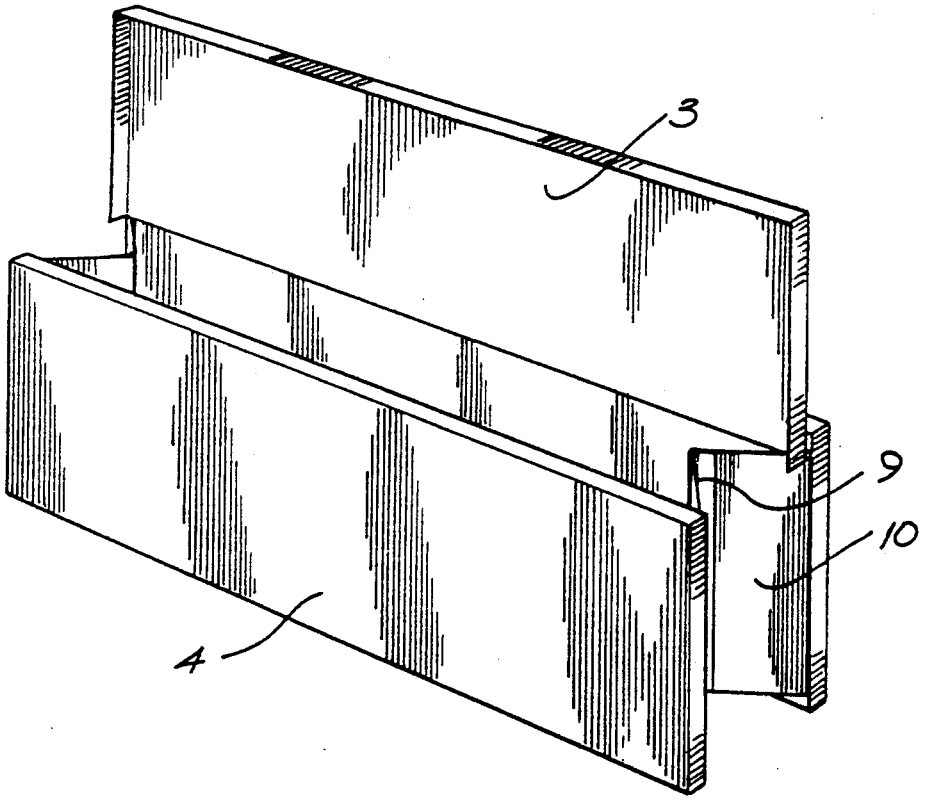
FIG. 2 is a perspective view of the box of FIG. 1 during folding.

A collapsible locker box 1 of the preferred embodiment as illustrated in the drawings includes a base 2, a lid 3, two side walls 4 and two end walls 5.

Figure 4:
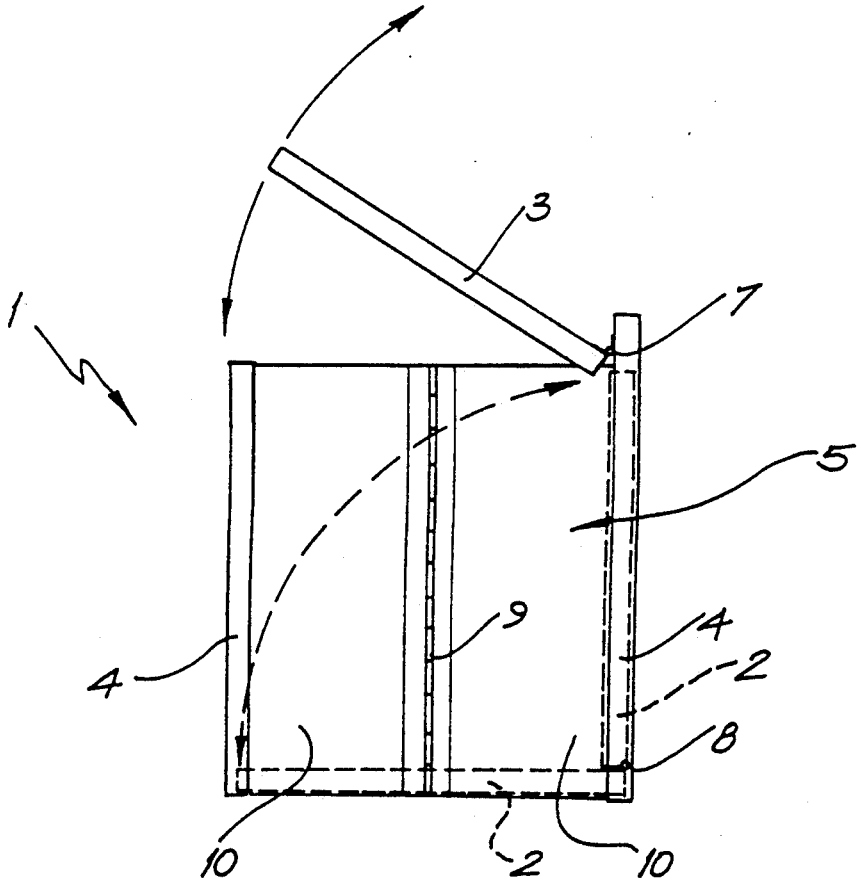
FIG. 4 is a side view of the box of FIG. 1 in the open configuration illustrating the movement of the base.

In use, the collapsible locker box 1 as illustrated in FIGS. 1 and 4 has the base 2 in a horizontal position. The two side walls 4A and 4B and two end walls 5A and 5B are positioned outside the periphery of the base 2. The lower edges of the side wall 4A and the end wall 5 are below the base 2. The two end walls 5 are parallel and each consists of two pivotal parts 10 which have a hinge 9 located therebetween. The lid 3 and base 2 are pivotally connected to the side wall 4B along the pivotal lines 7 and 8 respectively.

Illustrated in FIGS. 1 and 4, the lid 3 is shown in a slightly raised position to illustrate how a lip 6 on the lid 3 when closed surrounds the upper edges of the end walls 5 and side walls 4A.

Figure 3:
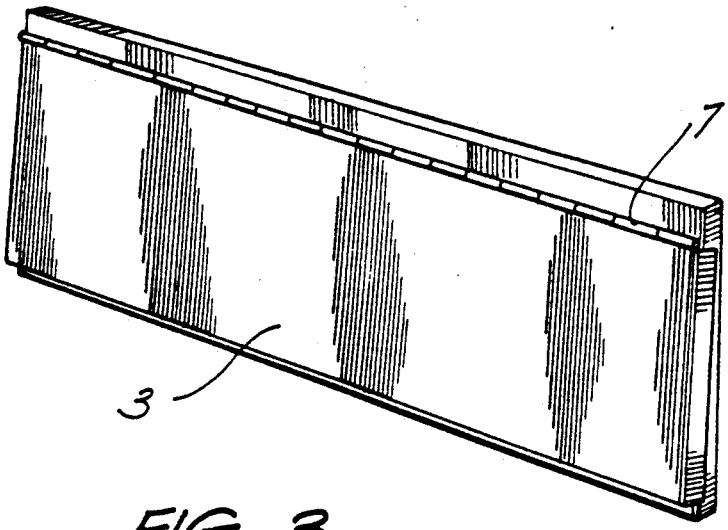
FIG. 3 is a perspective view of the box of FIG. 1 in a storage configuration.

The locker box 1 is used in the open configuration as illustrated in FIGS. 1 and 4 when the locker box is to be collapsed on the truck (not illustrated), the lid 3 is raised and the base 2 is pivoted into a vertical position. The base 2 is then substantially parallel to, and sandwiched between, the side walls 4. This enables the end walls 5 to be folded by means of pivoting of the parts 10 about the hinges 9. The two side walls 4 are then in the position as illustrated in FIG. 3 where they are closely spaced apart. The lid 3 is then able to be lowered to form a compact configuration which allows extra space to be used on the truck.

The foregoing describes only one embodiment of the present invention, and modifications obvious to those skilled in the art can be made thereto without departing from the scope of the present invention.

For example, the base 2 can be fixed to the side wall 4B but be below the lower edge of the end walls 5 and side wall 4A. The lid 3 would also be shorter (front to rear) in this configuration. A latch is used to rest in the end walls in the open configuration.

Similarly, the end walls 5 can fold outwardly, however this is a disadvantage if the length of the side walls 4 approaches the width of the truck tray or body.

What I claim is:

1. A locker for securing by a side wall to a structure and being movable whilst so secured between an operating configuration and a contracted configuration, the locker comprising a box having a base, two side walls, two end walls and a lid, wherein said end walls are foldable and said two side walls are movable between an operating position in which they are spaced apart by said end walls and a storage position in which said side walls are closely spaced together, and wherein said lid is pivotably joined adjacent to one top edge of one of said side walls, said lid being pivotable in said operating configuration to close said locker and pivotable in said storage configuration to lie co-planar with another one of said side walls to form a cover for said other one of said side walls when said locker is in said storage configuration.

2. The locker as claimed in claim 1, wherein said base is pivoted to said one of said side walls and extends across to said other of said side walls in said operating configuration, but is co-planar with, and sandwiched between, said side walls in said storage configuration.

3. The locker as claimed in claim 2, wherein said end walls are inwardly foldable.

4. The locker as claimed in claim 3, wherein said base in said operating configuration lies above the lower edges of said end walls thereby preventing said end walls folding inwardly when said locker is in said operating configuration.

5. The locker as claimed in claim 3, wherein each of said end walls is foldable along an axis parallel to planes of said side walls.

6. The locker as claimed in claim 4, wherein said axis is equidistant from said side walls.

7. The locker as claimed in claim 1, wherein said lid has side edges extending around an upper rim of said end walls and said other one of said side walls when said lid is closed and said locker is in said operating configuration.

* * * * *